US011139625B2

(12) United States Patent
Huber

(10) Patent No.: US 11,139,625 B2
(45) Date of Patent: Oct. 5, 2021

(54) DISCHARGE DEVICE FOR DISCHARGING ELECTRIC CURRENTS

(71) Applicant: SCHUNK CARBON TECHNOLOGY GMBH, Bad Goisern (AT)

(72) Inventor: Florian Huber, Bad Ischl (AT)

(73) Assignee: SCHUNK CARBON TECHNOLOGY GMBH, Bad Goisern (AT)

( * ) Notice: Subject to any disclaimer, the term of this patent is extended or adjusted under 35 U.S.C. 154(b) by 72 days.

(21) Appl. No.: 16/616,646

(22) PCT Filed: May 17, 2018

(86) PCT No.: PCT/EP2018/062854
§ 371 (c)(1),
(2) Date: Nov. 25, 2019

(87) PCT Pub. No.: WO2018/219658
PCT Pub. Date: Dec. 6, 2018

(65) Prior Publication Data

US 2020/0203908 A1 Jun. 25, 2020

(30) Foreign Application Priority Data

Jun. 1, 2017 (DE) ..... 10 2017 209 340.4

(51) Int. Cl.
*H01R 39/12* (2006.01)
*H01R 39/26* (2006.01)
(Continued)

(52) U.S. Cl.
CPC ..... *H01R 39/26* (2013.01); *H01R 39/20* (2013.01); *H01R 39/64* (2013.01)

(58) Field of Classification Search
CPC ..... H02K 11/40; H01R 39/64; H01R 39/12
See application file for complete search history.

(56) References Cited

U.S. PATENT DOCUMENTS 3,609,628 A * 9/1971 Cabaussel ..... H01R 39/64 439/16
5,804,903 A 9/1998 Fisher et al.
(Continued)

FOREIGN PATENT DOCUMENTS

CH 106070 A 8/1924
CN 201118076 Y 9/2008
(Continued)

*Primary Examiner* — Dang D Le
(74) *Attorney, Agent, or Firm* — Dickinson Wright PLLC; Andrew D. Dorisio

(57) ABSTRACT

A discharge device for discharging electric currents from a rotor part of a machine, in particular a rotor part with a shaft, into a stator part, the discharge device having a contact element, a support and a spring mechanism, the support being connectable to a stator part in an electrically conductive manner, the contact element being predominantly made of carbon, the contact element being accommodated on the support in an axially movable manner and connected to it in an electrically conductive manner, a contact force applicable to the contact element by the spring mechanism so as to establish an electrically conductive sliding contact between a sliding contact surface of the contact element to establish the sliding contact, and an axial shaft contact surface of the shaft, wherein the contact element is disk-shaped, the sliding contact surface being at least annular and disposable coaxially relative to the shaft contact surface.

23 Claims, 4 Drawing Sheets

Figure 29:
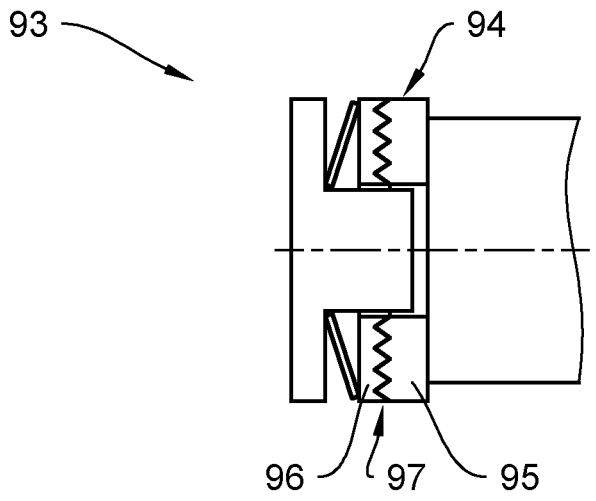

(51) Int. Cl.
*H01R 39/20* (2006.01)
*H01R 39/64* (2006.01)

(56) References Cited

U.S. PATENT DOCUMENTS 5,914,547 A * 6/1999 Barahia ..... H02K 11/40
310/71
6,686,673 B1 * 2/2004 Komura ..... F16C 17/10
310/67 R

FOREIGN PATENT DOCUMENTS

| | | | |
|---|---|---|---|
| CN | 102151965 | A | 8/2011 |
| CN | 202009148 | U | 10/2011 |
| CN | 203871620 | U | 10/2014 |
| CN | 106684661 | A | 5/2017 |
| DE | 903821 | C | 2/1954 |
| DE | 1091605 | B | 10/1960 |
| DE | 1953043 | A1 | 5/1970 |
| DE | 2308936 | A1 | 9/1974 |
| DE | 9205688 | U1 | 9/1992 |
| DE | 19920384 | C1 | 8/2000 |
| DE | 102008059994 | A1 | 6/2009 |
| DE | 102015110428 | A1 | 12/2016 |
| EP | 1136340 | A2 | 9/2001 |
| JP | S51133913 | A | 11/1976 |
| JP | 2001305896 | A | 11/2001 |
| WO | 2005064756 | A1 | 7/2005 |

* cited by examiner

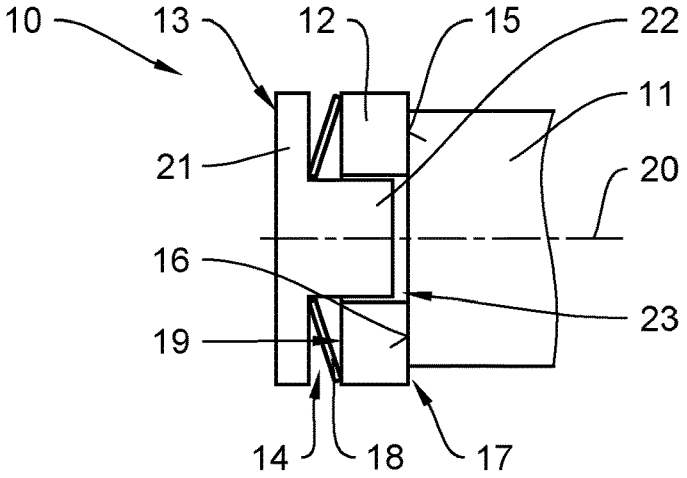
Fig. 1
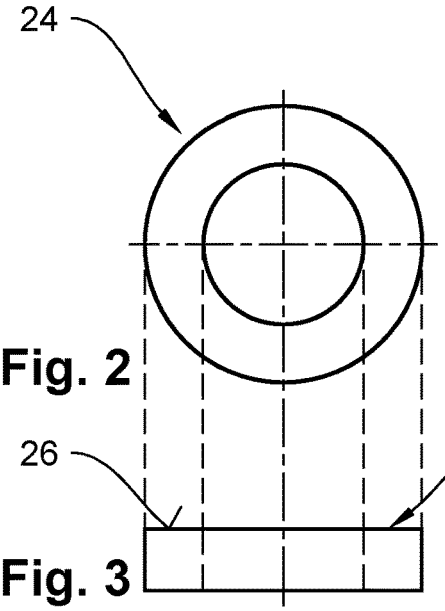
Fig. 2
Fig. 3
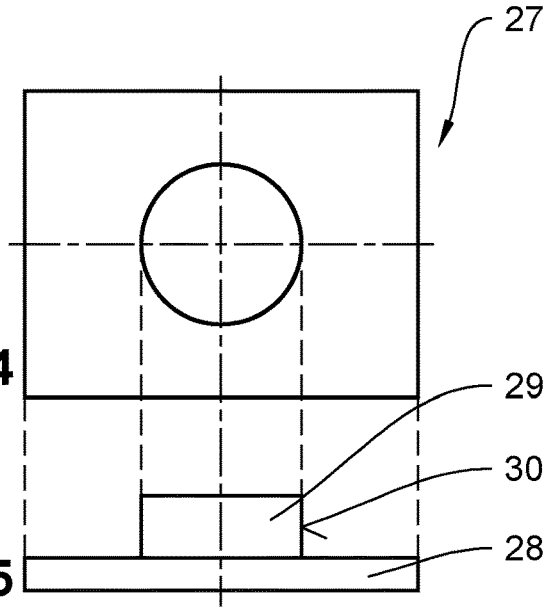
Fig. 4
Fig. 5
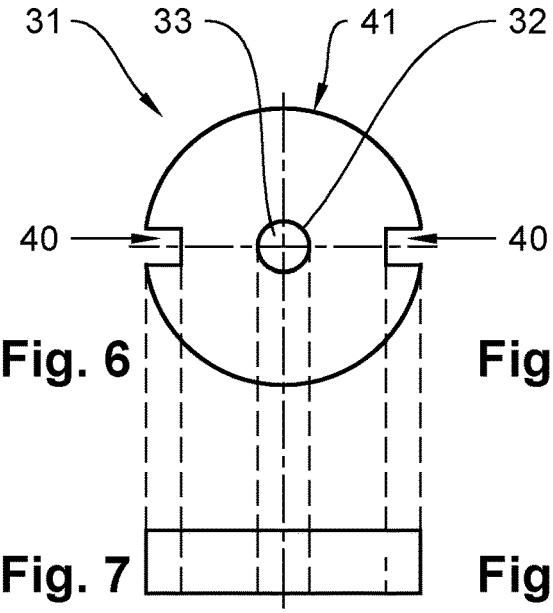
Fig. 6
Fig. 7
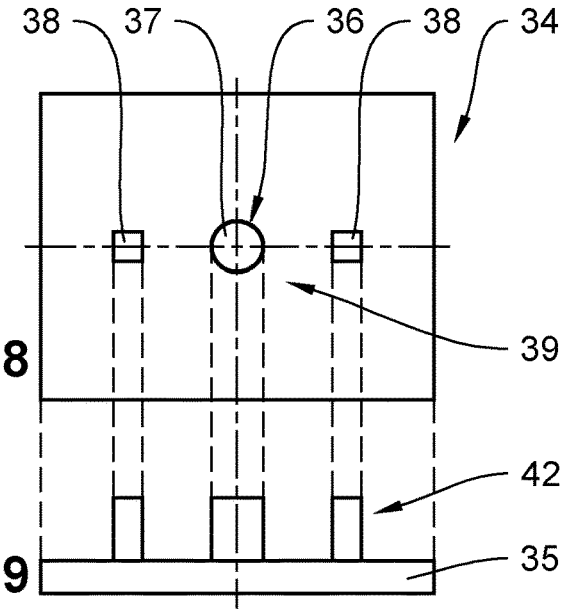
Fig. 8
Fig. 9

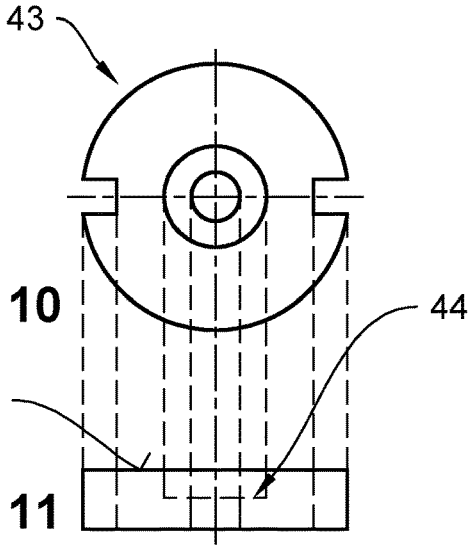
Fig. 10
Fig. 11
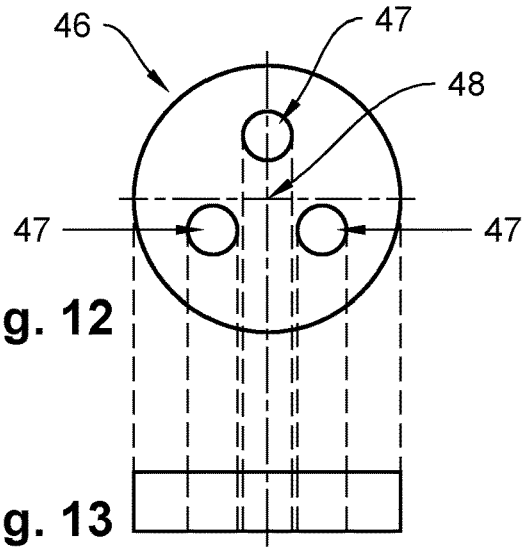
Fig. 12
Fig. 13
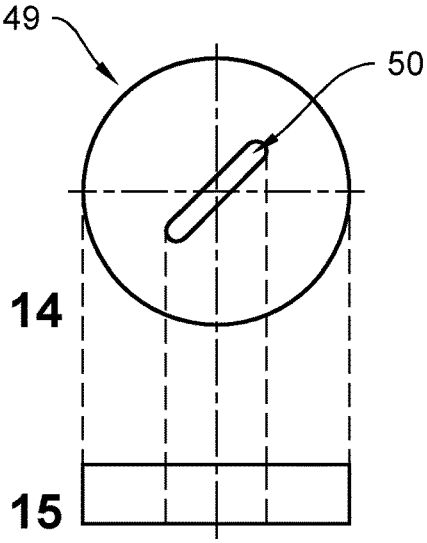
Fig. 14
Fig. 15
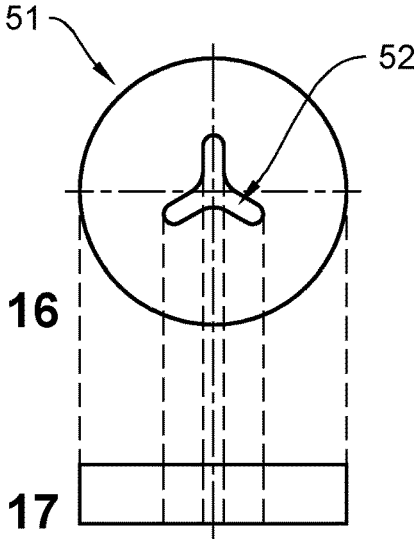
Fig. 16
Fig. 17
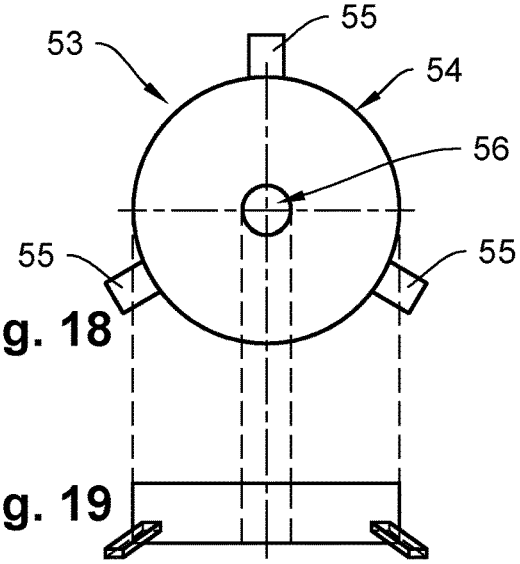
Fig. 18
Fig. 19
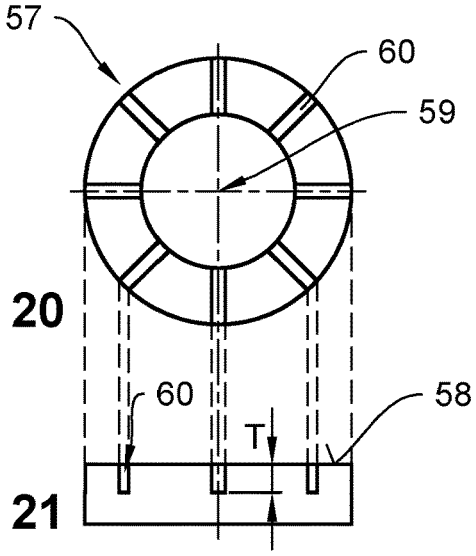
Fig. 20
Fig. 21

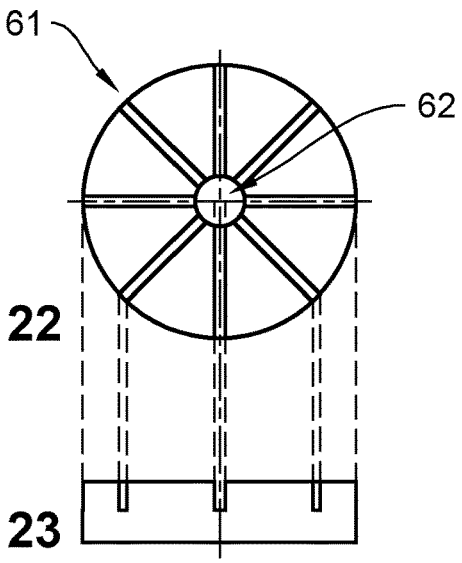
Fig. 22
Fig. 23
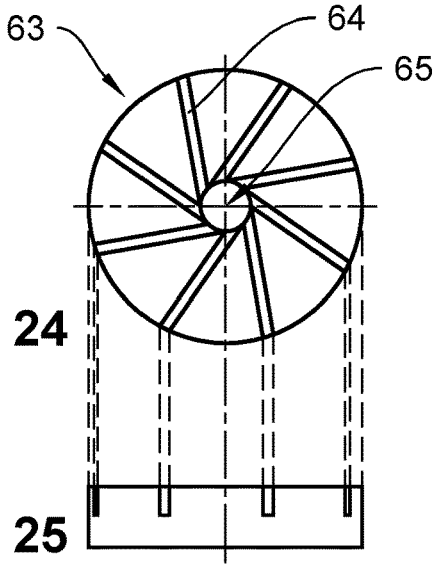
Fig. 24
Fig. 25
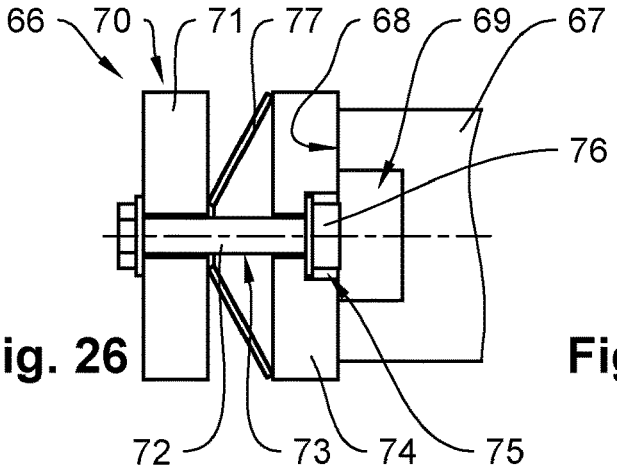
Fig. 26
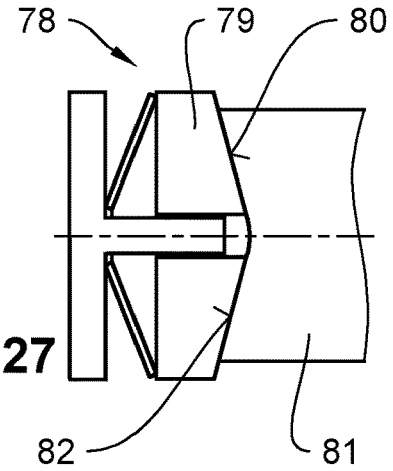
Fig. 27
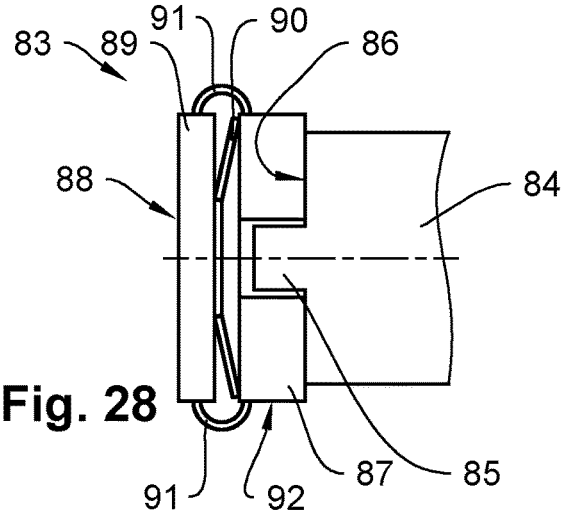
Fig. 28

DISCHARGE DEVICE FOR DISCHARGING ELECTRIC CURRENTS

FIELD OF THE INVENTION

The invention relates to a discharge device for discharging electric currents from a rotor part of a machine, in particular a rotor part realized with a shaft, into a stator part of the machine, and to a machine comprising a discharge device, the discharge device comprising a contact element, a support and a spring mechanism, the support being connectable to a stator part in an electrically conductive manner, the contact element being predominantly made of carbon, the contact element being accommodated on the support in an axially movable manner and being connected to it in an electrically conductive manner, a contact force being applicable to the contact element by means of the spring mechanism so as to establish an electrically conductive sliding contact between a sliding contact surface of the contact element, said sliding contact surface serving to establish the sliding contact, and an axial shaft contact surface of the shaft.

BACKGROUND OF THE INVENTION

Discharge devices of the aforementioned kind are known in different embodiments from the state of the art. In particular, it is known for carbon brushes to be used to discharge low-frequency direct currents, said carbon brushes being disposed on a slip ring in radial distribution around a shaft and being electrically connected to a stator via connecting stranded wires. Owing to their low electrical resistance, the carbon brushes, which are accommodated in a support or brush holder, allow direct discharging of electric currents and can thus avoid undesired current paths across bearing points of the shaft, which might cause surface damage to the bearing bodies or bearing rings because of spot welds.

The term "shaft" is used synonymously for the term "rotor part" or "axle". Hence, the term "shaft" refers to all rotating machine parts via which currents can be discharged into a fixed stator part or machine part of a machine.

Discharge devices are also frequently used in railway technology where alternating currents or an operating current may flow through wheel axles. For instance, DE 10 2010 039 847 A1 discloses a discharge device in which an electrically conductive end cap is mounted on an axial end of a shaft or wheel axle of a pair of wheels and can be brought into contact with a plurality of carbon brushes supported by brush holders and disposed relative to the shaft in the axial direction. Each carbon brush is directly connected to a grounding cable via a stranded wire, and a spring is used to exert a contact force on sliding contact surfaces of the carbon brushes.

Similar measures for discharging currents are required in electric machines in general, such as in motor vehicles. In motor drive shafts or connected gear shafts or other functional components, continuously fluctuating alternating voltages or currents and high-frequency current pulses can occur, which have the potential of also damaging bearing points of a rotor shaft or gear shaft, which is why discharge devices are typically required. However, the known discharge devices have the disadvantage that they require a lot of installation space by design. While solutions are known in which fiber or wire meshes are used instead of carbon brushes, fiber and wire meshes have a high transition resistance because of a very small contact surface of a sliding contact, and only small currents can be discharged. To form a large contact surface with the shaft, however, a plurality of carbon brushes is required, which, because of how they are disposed, each require brush holders with a relatively large installation space and corresponding installation work.

SUMMARY OF THE INVENTION

Therefore, the object of the present invention is to propose a discharge device that has a low transition resistance and that is easy to install while requiring little installation space.

Said object is attained by a discharge device having the features of claim 1 and by a machine having the features of claim 23.

The discharge device according to the invention for discharging electric currents from a rotor part of a machine, in particular a rotor part realized with a shaft, into a stator part of the machine comprises a contact element, a support and a spring mechanism, the support being connectable to a stator part in an electrically conductive manner, the contact element being predominantly made of carbon, the contact element being accommodated on the support in an axially movable manner and being connected to it in an electrically conductive manner, a contact force being applicable to the contact element by means of the spring mechanism so as to establish an electrically conductive sliding contact between a sliding contact surface of the contact element, said sliding contact surface serving to establish the sliding contact, and an axial shaft contact surface of the shaft, wherein the contact element is disk-shaped, the sliding contact surface being at least annular, preferably circular, and disposable coaxially relative to the shaft contact surface, the support having a base plate, the spring element being disposed between the base plate and a contact pressure side of the contact element, said contact pressure side facing away from a contact surface side, which has the sliding contact surface.

Accordingly, the discharge device is configured to be mounted on a rotating shaft or axle of a machine. The discharge device may be disposed on an axial end of the shaft and may establish the electrically conductive sliding contact by establishing contact between the axial shaft contact surface of the shaft at the axial end of the shaft or an end face of the shaft and the contact element. By means of the spring mechanism, the contact force acting axially in the direction of an axis of rotation of the shaft can then be applied to the contact element, causing the sliding contact surface of the contact element to be pressed against the shaft contact surface. Since the contact element is disk-shaped, i.e. realized in the shape of a disk or plate, installation space can be saved compared to a conventional contact strip because the contact element is relatively short or thin with respect to its axial direction. Furthermore, the disk shape or plate shape of the contact element allows the contact element to be realized with an at least annular sliding contact surface, which can then be disposed coaxially relative to the shaft contact surface. The circular shape of the sliding contact surface is a result of a rotation of the shaft or of the shaft contact surface. Thus, a relatively large sliding contact surface which allows a sliding contact of low transition resistance to be established can be realized. However, the disk shape or plate shape of the contact element can also be selected such that a contour of the contact element protrudes beyond the sliding contact surface. Accordingly, the contact element can also be polygonal and still have a circular sliding contact surface. Since an abrasive wear of the sliding contact decreases in relation to the large sliding contact surface, the contact element can also be disk-shaped or thin without wearing substantially faster than a contact element having a smaller sliding contact surface and great length as known from the state of the art. Also, it is no longer required to mount a plurality of contact elements on the shaft in order to achieve a low transition resistance because a single disk-shaped contact element can establish a sufficiently large sliding contact. Thus, the discharge device requires little installation space and is also easy to install.

The support according to the invention has a base plate, the spring element being disposed between the base plate and a contact pressure side of the contact element, said contact pressure side facing away from a contact surface side, which has the sliding contact surface. Consequently, the spring element is simply disposed between the base plate and the contact element. In a particularly simple embodiment of the discharge device, it may be composed of no more than three components, which can be plugged into each other. This makes assembly of the discharge device particularly simple. If the spring mechanism or the spring element is an especially flat spring, such as a disk spring, an installation space of the discharge device can be reduced even further. The base plate can be attached to a stator part of a machine simply by means of a screwed, plugged or glued connection. An electrically conductive connection of the base plate can also be realized via said connection to the stator part or also through direct connection of a grounding cable to the base plate.

An outer diameter or maximum outer dimension of the disk-shaped contact element may be a multiple of a thickness of the contact element. The outer dimension/thickness ratio of the contact element may be 2:1, 3:1, 4:1, 5:1 or 10:1.

For example, the sliding contact surface or an end face of the contact element relative to the axial end of the shaft may be of such a size that the contact element protrudes beyond a diameter of the shaft at the axial end in terms of its radial dimensions. Furthermore, the sliding contact surface may also be in the form of a full circle. The contact element may be configured such that its radial size comes close or corresponds to a diameter of the axial end of the shaft because this allows a particularly large sliding contact to be formed.

The contact element may be realized in one piece and consist predominantly of carbon. For instance, the contact element may be a carbon mold which is produced by pressing and firing or sintering. The contact element may consist of graphite, carbon black, carbon fibers or a mixture of these materials and may contain particles of the metals iron, nickel, manganese, copper, zinc, silver, aluminum and/or chromium and a binder or a binder phase.

The support may consist of metal, preferably of steel, aluminum, copper or an alloy of these materials. In this case, the support can be easily produced in large quantities at low cost by injection molding, for example, or by simple mechanical processing of semi-finished products made of these materials. The support may be connected directly to a stator part or a housing part of a machine in a fixed and electrically conductive manner by screwing, for example. Also, a grounding cable can be easily attached to or installed on the support. The support may be realized in one piece or in multiple pieces.

The support and the contact element together may form a lock against rotation for the contact element. In this way, the support can be attached to the stator part in a fixed manner and the contact element can be disposed, also in a fixed manner relative to a rotating shaft, on the support and can be brought in contact with the shaft. Otherwise, the contact element might rotate with the shaft, in particular because of the annular shape and the coaxial arrangement of the sliding contact surface, which would mean that there would be no sliding contact with the shaft. The lock against rotation can be realized by simply accommodating the contact element on the support in a form-fitting manner such that the contact element can move axially on the support and radial movement of the contact element relative to the support is prevented.

The spring mechanism may have a spring element, preferably a spiral spring, a compression spring, a disk spring, a leaf spring, a conical spring, an annular spring or a diaphragm spring, which may be disposed coaxially relative to the sliding contact surface or to an axis of rotation of the shaft. In this way, it is also possible for a contact pressure force or spring force acting in the direction of the axis of rotation of the shaft to be exerted on the contact element by means of the spring mechanism and to thus establish the contact force.

The contact element may be composed of at least two layers having different material mixtures. Accordingly, the contact element may have at least two layers, which have different physical properties and thus different functionalities.

The layers may be formed back to back in the axial direction, wherein the sliding contact surface may be formed by a sliding layer having a copper content of <60 wt % and the contact pressure side may be formed by a bonding layer having a copper content of >80 wt %, wherein an expansion layer may preferably be formed between the sliding layer and the bonding layer. For example, the bonding layer may have a copper content of 90 to 99 wt % with additions of tin or zinc of up to 9 wt % and a graphite content of no more than 3 wt %, making it solderable and weldable. In this way, the bonding layer exhibits particularly good wettability with lead-free solder and is also weldable. Moreover, the bonding layer has a high flexural strength of more than 100 MPa, which gives the bonding layer high resistance against tensile, shear and compressive mechanical stress. The sliding layer may also have a copper content of <50 wt % or may even be entirely free of copper. This results in good sliding properties at little wear and thus in a long lifespan and in chemical stability. Structurally, the different layers may also differ in terms of their isotropy/anisotropy. The bonding layer may be isotropic, whereas the sliding layer may be either isotropic or anisotropic. In this case, the lubricating effect of the graphite employed in the sliding layer can be used optimally, in particular through a preferred graphite orientation parallel to the sliding plane. A thermal expansion behavior of the sliding layer can be adjusted through the isotropy/anisotropy. The optional expansion layer may serve to even out any differences between the thermal expansion coefficients of the sliding layer and of the bonding layer.

The contact element may be realized with a contoured transition zone between the layers by sintering. When the contact element is produced by sintering, the respective layers can be easily formed from accordingly selected powder mixtures. Furthermore, a contour may be formed in the transition zone between the respective layers, the layers thus interlocking in the axial direction. The contour can be formed by first compacting a first layer with a correspondingly contoured die in a mold and then filling in the second layer in the form of a powder mixture and compacting it.

The support may have at least one guiding element assembly which extends in the axial direction and on which the contact element can be axially moved. The guiding element assembly may form a profile which is continuous in the axial direction or in the direction of an axis of rotation of the shaft, thus ensuring axial displaceability of the contact element. A length of the guiding element assembly in the axial direction may always be such that the contact element can be partially or completely consumed by abrasive wear without the contact element coming off of the guiding element assembly as it is being displaced in the axial direction by means of the spring mechanism.

At its circumference, the contact element may have a guiding contour which is inserted into the guiding element assembly. Accordingly, the guiding element assembly may partially or entirely surround the contact element at its circumference. The circumference or guiding contour of the contact element may be polygonal or partially or entirely round. For instance, notches or grooves into which the guiding element assembly engages may be formed at the circumference in the axial direction. In principle, the contact element may be configured in such a manner that it is supported on the base plate by the guiding element assembly solely at its circumference.

The contact element may also have a guiding recess into which the guiding element assembly or a guiding pin of the shaft can engage. The guiding recess may be a bore formed along a longitudinal axis of the contact element, the contact element thus forming the annular sliding contact surface. The guiding recess may be a through hole in the contact element or a blind hole-shaped recess in the contact element. Optionally or alternatively, the guiding recess may be a centric bore on the contact element, allowing the contact element to be plugged onto a guiding pin or on a stepped diameter of the shaft. Thus, the shaft can serve to radially fix the contact element.

The guiding recess and the guiding element assembly may have corresponding cross-sections. This allows the contact element to be guided and thus displaceable in the axial direction. Also, depending on the selected cross-sectional shape, the corresponding cross-sections may form a lock against rotation. For example, the cross-section may be circular, quadratic, rectangular or polygonal. Thus, instead of a round bore, a polygonal guiding recess and a correspondingly shaped guiding pin may be provided, which together form a lock against rotation. In this case, a clearance fit may also be formed between the guiding recess and the guiding element assembly.

The guiding element assembly may be disposed coaxially with the sliding contact surface. This ensures that the contact element can always be disposed centrically at the axial end of the shaft relative to an axis of rotation of the shaft. Consequently, a center of gravity of the sliding contact surface can always correspond to a center of gravity of the shaft contact surface, in which case both centers of gravity can also be located on the axis of rotation of the shaft. Also, the contact element may be rotationally symmetrical.

The guiding element assembly may have at least one guiding element, preferably a plurality of guiding elements. A guiding element may be a simple pin-shaped protrusion of the support, for example. Furthermore, the guiding element may also be a screw of the support. The guiding element may also be a protrusion with polygonal cross-section and may basically have any cross-sectional shape. Furthermore, a plurality of guiding elements having the cross-sectional shapes described above may be used, if appropriate.

The guiding element may be integral to a base plate of the support or may be plugged into the base plate. In a simple embodiment, the guiding element may be a pin which is simply inserted into a bore of the base plate. Likewise, a pin-shaped guiding element may be integral to the base plate in the manner of a protrusion. The base plate may also have a centric bore into which a screw is inserted or screwed.

If the support has an integrally molded guiding element, the support may also be realized in one piece. The support may simply be produced by injection molding or by machining of a semi-finished product. An inner surface of the guiding recess may be in electrically conductive contact with an outer surface of the guiding element. This allows electric current to be transmitted from the contact element to the support at low transition resistance. If the guiding recess is a bore, for example, the inner surface of the bore may be in electrically conductive contact with an outer surface of a pin or journal as a guiding element. The inner surface and the outer surface or the respective diameters may form a clearance fit which ensures a low transition resistance at all times. Axial displaceability may be ensured simply by the carbon of the contact element and by a consequently advantageous friction pairing of the inner surface and the outer surface.

The guiding element may be disposed on the support concentrically relative to the shaft contact surface. Consequently, the guiding element may also always be disposed concentrically with the shaft contact surface.

Additionally or alternatively, the guiding element may be disposed on the support eccentrically relative to the shaft contact surface. In that case, however, a plurality of guiding elements should be present and said guiding elements should be disposed on the support eccentrically to the shaft contact surface in such a manner that the guiding elements are always distributed evenly, e.g., equidistantly to one another, relative to an axis of rotation of the shaft.

At least one groove running in the axial direction may be formed in the sliding contact surface. Furthermore, a plurality of grooves running radially outward from a centric center, for example, may also be formed in the sliding contact surface. The groove may have a depth that corresponds to a maximum wear depth of the contact element. By means of the groove, oil on the established sliding contact or abraded particles may be collected and radially discharged in the groove. The groove may also run spirally or may be disposed in the manner of a passant with respect to a center of the sliding contact surface.

A particularly good discharging of electric currents becomes possible if the contact element is connected to the support via at least one electrically conductive stranded wire or a flexible flat metal tape. The stranded wire can be placed in the contact element during production or can be attached to the contact element by soldering or gluing, for example. Preferably, the contact element has a plurality of stranded wires attached to a circumference of the contact element and spaced equidistantly. The stranded wire may also be attached to the support easily by means of terminals or screws or by soldering. By using a stranded wired, a transition resistance can be reduced even further. The stranded wire may also be connected directly to a stator part of the machine. The machine according to the invention has a discharge device according to the invention. Advantageous embodiments of a machine are apparent from the features of the claims dependent on device claim 1.

BRIEF DESCRIPTION OF THE DRAWING FIGURES

Hereinafter, advantageous embodiments of the invention are explained in more detail with reference to the accompanying drawings.

Figure 30:
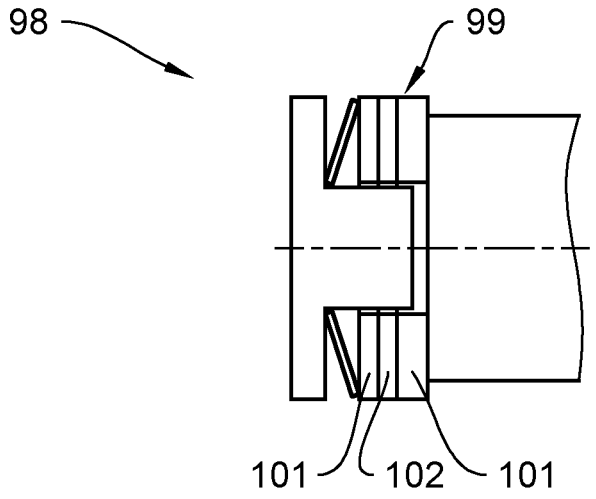

FIG. 1: is a section view of a first embodiment of a discharge device on a shaft;

FIG. 2: is a top view of a contact element according to the first embodiment of the discharge device;

FIG. 3: is a side view of the contact element of FIG. 2;

FIG. 4: is a top view of a base plate according to the first embodiment of the discharge device;

FIG. 5: is a side view of the base plate of FIG. 4;

FIG. 6: is a top view of a second embodiment of a contact element;

FIG. 7: is a side view of the contact element of FIG. 6;

FIG. 8: is a top view of a second embodiment of a base plate;

FIG. 9: is a side view of the base plate of FIG. 8;

FIG. 10: is a top view of a third embodiment of a contact element;

FIG. 11: is a side view of the contact element of FIG. 10;

FIG. 12: is a top view of a fourth embodiment of a contact element;

FIG. 13: is a side view of the contact element of FIG. 12;

FIG. 14: is a top view of a fifth embodiment of a contact element;

FIG. 15: is a side view of the contact element of FIG. 14;

FIG. 16: is a top view of a sixth embodiment of a contact element;

FIG. 17: is a side view of the contact element of FIG. 16;

FIG. 18: is a top view of a seventh embodiment of a contact element;

FIG. 19: is a side view of the contact element of FIG. 18;

FIG. 20: is a top view of an eighth embodiment of a contact element;

FIG. 21: is a side view of the contact element of FIG. 20;

FIG. 22: is a top view of a ninth embodiment of a contact element;

FIG. 23: is a side view of the contact element of FIG. 22;

FIG. 24: is a top view of a tenth embodiment of a contact element;

FIG. 25: is a side view of the contact element of FIG. 24;

FIG. 26: is a section view of a second embodiment of a discharge device on a shaft;

FIG. 27: is a section view of a third embodiment of a discharge device on a shaft;

FIG. 28: is a section view of a fourth embodiment of a discharge device on a shaft;

FIG. 29: is a section view of a fifth embodiment of a discharge device on a shaft;

FIG. 30: is a section view of a sixth embodiment of a discharge device on a shaft.

DETAILED DESCRIPTION OF THE INVENTION

FIG. 1 shows a section view of a discharge device 10 on a shaft 11. Discharge device 10 is composed of a contact element 12, a support 13 and a spring mechanism 14. Contact element 12 consists predominantly of carbon, is circular and has a sliding contact surface 15 which is in contact with an end-side or axial shaft contact surface 16 of shaft 11, whereby an electrically conductive sliding contact 17 is established. Spring mechanism 14 is formed by a disk spring 18 which is in contact with a contact pressure side 19 of contact element 12 and exerts a contact force on contact element 12 in an axial direction relative to an axis of rotation 20 of shaft 11. Support 13 is composed of a base plate 21 having a guiding element 22 formed thereon, which is circular in the case at hand. Because of its annular shape, contact element 12 has a guiding recess 23 to which guiding element 22 is configured correspondingly in such a manner that contact element 12 is axially displaceable on support 13 relative to axis of rotation 20. Disk spring 18 is plugged onto guiding element 22 and bears against base plate 21. Base plate 21 and guiding element 22 are realized in one piece from metal and are attached to a fixed component of an electric machine (not shown). On the whole, a good electrically conductive connection with low transition resistance from shaft 11 to support 13 can be established via contact element 12 in this way. Also, discharge device 10 can be installed on an electric machine particularly quickly and simply.

FIGS. 2 and 3 show a contact element 24 which is annular and rotationally symmetrical. Contact element 24 forms a sliding contact surface at an end face 25.

FIGS. 4 and 5 show a support 27 which is realized in one piece and which has a rectangular base plate 28 with an integral guiding element 29 which is pin-shaped or bolt-shaped. The contact element of FIG. 2 can be plugged onto an outer surface 30 of guiding element 29.

A combined view of FIGS. 6 to 9 shows a contact element 31 which is disk-shaped and which has a centric bore 32 which forms a guiding recess 33. A support 34 gas a guiding pin 37 as a guiding element 36 on a base plate 35, said guiding pin 37 corresponding to bore 32. Furthermore, quadratic guiding pins 38 which form a guiding element assembly 39 together with guiding pin 37 are formed in base plate 35. Guiding pins 38 can engage into grooves 40 in a circumference 41 of contact element 31, thus forming a lock against rotation 42 for contact element 32 on support 34.

FIGS. 10 and 11 show a contact element 43 which differs from the contact element of FIG. 6 in that it has a depression 44. Depression 44 is formed in a sliding contact surface 45 and serves to receive a screw head of a screw (not shown) which can serve to attach contact element 43 to a support or base plate and guide it thereon.

FIGS. 12 and 13 show a contact element 46 having three guiding recesses 47 which are formed in contact element 46 and which are eccentric relative to an axis of rotation 48 of a shaft (not shown) and spaced equidistantly.

FIGS. 14 and 15 show a contact element 49 having a slot-shaped guiding recess 50.

FIGS. 16 and 17 show a contact element 51 having a polygonal guiding recess.

FIGS. 18 and 19 show a contact element 53 having stranded wires 55 (shown in part) which emerge from contact element 53 at its circumference 54 and which can be connected to a support (not shown). A centric guiding recess 56 and equidistantly disposed stranded wires 55 center contact element 53 on the support.

FIGS. 20 and 21 show a contact element 57 which differs from the contact element of FIG. 2 in that, in a sliding contact surface 58, it has grooves 60 running in the radial direction relative to an axis of rotation 59 of a shaft (not shown). A radial depth T of the grooves corresponds to a wear length of contact element 57.

FIGS. 22 and 23 show a contact element 61 which differs from the contact element of FIG. 20 in that it has a relatively small guiding recess 62.

FIGS. 24 and 25 show a contact element 63 which differs from the contact element of FIG. 22 in that it has grooves 64 which run in the manner of a passant relative to an axis of rotation 65 of a shaft (not shown), which means that they do not intersect axis of rotation 65 but are still disposed in the radial direction.

FIG. 26 shows a discharge device 66 on a shaft 67 which has a centric recess 69 in an end face 68. Discharge device 66 is composed of a support 70 having a base plate 71 and a screw 72 attached thereto as guiding element 73, a contact element 74 of discharge device 66 having a depression 75 which serves to receive a screw head 76 of screw 72. Depression 69 is also large enough for screw head 76 to not come into contact with end face 68 when contact element 74 wears. A disk spring 77 for exerting a contact force is disposed between contact element 74 and base plate 71.

FIG. 27 shows a discharge device 78 having a contact element 79 which forms a conical sliding contact surface 80. A shaft 81 also forms a conical shaft contact surface 82 which matches sliding contact surface 80. In this way, contact element 79 can be easily centered on shaft 81.

FIG. 28 shows a discharge device 83 on a shaft 84 which has a journal 85 on an end face 86. Discharge device 83 comprises an annular contact element 87 which is plugged onto journal 85, a support 88 having a base plate 89, a disk spring 90, and stranded wires 91 which emerge from contact element 87 at its circumference 92 and are attached to base plate 89. Thus, a particularly good electrically conductive connection can be established between contact element 87 and base plate 89.

FIG. 29 shows a discharge device 93 which differs from the discharge device of FIG. 1 in that it has a contact element 94 which has a sliding layer 95 and a bonding layer 96. Sliding layer 95 has a copper content of <60 wt %, and bonding layer 96 has a copper content of >80 wt %. A transition zone 97 between sliding layer 95 and bonding layer 96 is contoured. Contact element 94 is produced by sintering different powder mixtures.

FIG. 30 shows a discharge device 98 which differs from the discharge device of FIG. 29 in that it has a contact element 99 having a sliding layer 100 and a bonding layer 101, an expansion layer 102 being formed between them. Expansion layer 102 evens out differing thermal expansion coefficients of sliding layer 100 and bonding layer 101.

The invention claimed is:

1. A discharge device (10, 66, 78, 83, 93, 98) for discharging electric currents from a rotor part of a machine, in particular a rotor part realized with a shaft (11, 67, 81, 84), into a stator part of the machine, the discharge device comprising a contact element (12, 24, 31, 43, 46, 49, 51, 53, 57, 61, 63, 74, 79, 87, 94, 99), a support (13, 27, 34, 70, 88) and a spring mechanism (14), the support being connectable to a stator part in an electrically conductive manner, the contact element being predominantly made of carbon, the contact element being accommodated on the support in an axially movable manner and being connected to the support in an electrically conductive manner, a contact force being applicable to the contact element by means of the spring mechanism so as to establish an electrically conductive sliding contact (17) between a sliding contact surface (15, 26, 45, 58, 80) of the contact element, said sliding contact surface serving to establish the sliding contact, and an axial shaft contact surface (16, 82) of the shaft, characterized in that the contact element is disk-shaped, the sliding contact surface being at least annular and disposable coaxially relative to the shaft contact surface, the support having a base plate (21, 28, 35, 71, 89), the spring element being disposed between the base plate and a contact pressure side (19) of the contact element, said contact pressure side facing away from a contact surface side, which has the sliding contact surface.

2. The discharge device according to claim 1, characterized in that the contact element (12, 24, 31, 43, 46, 49, 51, 53, 57, 61, 63, 74, 79, 87, 94, 99) is realized in one piece and consists predominantly of carbon.

3. The discharge device according to claim 1, characterized in that the support (13, 27, 34, 70, 88) is made of a metal selected from the group comprising steel, aluminum, copper or an alloy of these materials.

4. The discharge device according to claim 1, characterized in that the support (13, 27, 34, 70, 88) and the contact element (12, 24, 31, 43, 46, 49, 51, 53, 57, 61, 63, 74, 79, 87, 94, 99) together form a lock against rotation (42) for the contact element.

5. The discharge device according to claim 1, characterized in that the spring mechanism (14) has a spring element selected from the group comprising a spiral spring, a compression spring, a disk spring (18, 77, 90), a leaf spring, a conical spring, an annular spring or a diaphragm spring, the spring element being disposed coaxially relative to the sliding contact surface (15, 26, 45, 58, 80).

6. The discharge device according to claim 1, characterized in that the contact element (12, 24, 31, 43, 46, 49, 51, 53, 57, 61, 63, 74, 79, 87, 94, 99) is composed of at least two layers (95, 96, 100, 101, 102) having different material mixtures.

7. The discharge device according to claim 6, characterized in that the layers (95, 96, 100, 101, 102) are formed back to back in the axial direction, the sliding contact surface (15, 26, 45, 58, 80) being formed by a sliding layer (95, 100) having a copper content of <60 wt % and the contact pressure side (19) being formed by a bonding layer (96, 101) having a copper content of >80 wt %, an expansion layer (102) formed between the sliding layer and the bonding layer.

8. The discharge device according to claim 6, characterized in that the contact element (12, 24, 31, 43, 46, 49, 51, 53, 57, 61, 63, 74, 79, 87, 94, 99) is realized with a contoured transition zone (97) between the layers (95, 96, 100, 101, 102) by sintering.

9. The discharge device according to claim 1, characterized in that the support (13, 27, 34, 70, 88) has at least one guiding element assembly (39) which extends in the axial direction and on which the contact element (12, 24, 31, 43, 46, 49, 51, 53, 57, 61, 63, 74, 79, 87, 94, 99) can axially slide.

10. The discharge device according to claim 9, characterized in that at its circumference (41, 54, 92), the contact element (12, 24, 31, 43, 46, 49, 51, 53, 57, 61, 63, 74, 79, 87, 94, 99) has a guiding contour which is inserted into the guiding element assembly (39).

11. The discharge device according to claim 9, characterized in that the contact element (12, 24, 31, 43, 46, 49, 51, 53, 57, 61, 63, 74, 79, 87, 94, 99) has a guiding recess (23, 33, 47, 50, 52, 56, 62) into which the guiding element assembly (39) or a guiding pin (85) of the shaft (11, 67, 81, 84) engages.

12. The discharge device according to claim 11, characterized in that the guiding recess (23, 33, 47, 50, 52, 56, 62) and the guiding element assembly (39) have corresponding cross-sections.

13. The discharge device according to claim 9, characterized in that the guiding element assembly (39) is disposed coaxially with the sliding contact surface (15, 26, 45, 58, 80).

14. The discharge device according to claim 9, characterized in that the guiding element assembly (39) has at least one guiding element (22, 29, 36, 73).

15. The discharge device according to claim 14, characterized in that the guiding element (22, 29, 36, 73) is integral to a base plate (21, 28, 35, 71, 89) of the support (13, 27, 34, 70, 88) or plugged into the base plate.

16. The discharge device according to claim 14, characterized in that the support (13, 27, 34, 70, 88) is realized in one piece.

17. The discharge device according to claim 14, characterized in that an inner surface of the guiding recess (23, 33, 47, 50, 52, 56, 62) is in electrically conductive contact with an outer surface (30) of the guiding element (22, 29, 36, 73).

18. The discharge device according to claim 14, characterized in that the guiding element (22, 29, 36, 73) is disposed on the support (13, 27, 34, 70, 88) concentrically relative to the shaft contact surface (16, 82).

19. The discharge device according to claim 14, characterized in that the guiding element is disposed on the support eccentrically relative to the shaft contact surface.

20. The discharge device according to claim 1, characterized in that at least one groove (60, 64) running in the radial direction is formed in the sliding contact surface (58).

21. The discharge device according to claim 1, characterized in that the contact element (53, 87) is connected to the support (88) via at least one electrically conductive stranded wire (55, 91) or a flexible flat metal tape.

22. The discharge device according to claim 1, characterized in that the sliding contact surface (80) is conical in order to come into contact with a correspondingly shaped shaft contact surface (82).

23. A machine comprising a discharge device (10, 66, 78, 83, 93, 98) of claim 1.

* * * * *